US012025404B1

(12) United States Patent
Ballard et al.

(10) Patent No.: US 12,025,404 B1
(45) Date of Patent: Jul. 2, 2024

(54) SYSTEM FOR PIVOTING A BUFFER TUBE ASSEMBLY

(71) Applicant: Springfield, Inc., Geneseo, IL (US)

(72) Inventors: Nick Ballard, Galva, IL (US); Charles David Williams, Geneseo, IL (US); Benjamin Boyd McKelvain, Geneseo, IL (US)

(73) Assignee: Springfield, Inc., Geneseo, IL (US)

( * ) Notice: Subject to any disclaimer, the term of this patent is extended or adjusted under 35 U.S.C. 154(b) by 0 days.

(21) Appl. No.: 18/176,171

(22) Filed: Feb. 28, 2023

Related U.S. Application Data

(60) Provisional application No. 63/315,052, filed on Feb. 28, 2022.

(51) Int. Cl.
*F41C 23/04* (2006.01)
*F41A 3/84* (2006.01)
*F41A 3/88* (2006.01)

(52) U.S. Cl.
CPC ..... *F41C 23/04* (2013.01); *F41A 3/84* (2013.01); *F41A 3/88* (2013.01)

(58) Field of Classification Search
CPC ..... F41C 23/04; F41A 11/04
See application file for complete search history.

(56) References Cited

U.S. PATENT DOCUMENTS

| | | | | |
|---|---|---|---|---|
| 7,966,761 | B1 | 6/2011 | Kuczynko et al. | |
| 8,245,429 | B2 | 8/2012 | Kuczynko et al. | |
| 8,631,601 | B2 | 1/2014 | Langevin et al. | |
| 8,769,855 | B2 | 7/2014 | Law | |
| 8,955,422 | B1 | 2/2015 | Schumacher | |
| 8,991,088 | B1 | 3/2015 | Young | |
| 9,347,738 | B1 | 5/2016 | Schumacher | |
| 9,546,845 | B2 | 1/2017 | Mather | |
| 9,719,754 | B2 | 8/2017 | Law | |
| 10,113,832 | B2 | 10/2018 | Law | |
| 10,371,474 | B2 | 8/2019 | Young | |
| 10,704,848 | B1 * | 7/2020 | Zeider | F41A 3/66 |
| 11,015,885 | B1 | 5/2021 | Roth | |
| 11,143,470 | B1 * | 10/2021 | Roth | F41A 3/66 |
| 11,499,795 | B2 | 11/2022 | Law | |
| 11,609,066 | B1 * | 3/2023 | Newby | F41C 23/04 |
| 2019/0339038 | A1 * | 11/2019 | Law | F41A 11/04 |
| 2020/0191509 | A1 | 6/2020 | Young | |
| 2023/0304754 | A1 * | 9/2023 | Noonan | F41C 23/04 |

* cited by examiner

*Primary Examiner* — Derrick R Morgan
(74) *Attorney, Agent, or Firm* — Woodard, Emhardt, Henry, Reeves & Wagner, LLP

(57) ABSTRACT

A firearm assembly includes an upper receiver housing a bolt carrier group that is translatable within the upper receiver, and a lower receiver including a first hinge portion defining a first hinge opening. A second hinge portion is pivotally connected to the first hinge portion, and a buffer assembly is attached to the second hinge portion. A carrier block is positioned within the first hinge portion and is configurable in a blocking configuration and an unblocking configuration. The second hinge portion is in mechanical communication with the carrier block when the second hinge portion is configured in a folded position. At least a portion of the carrier block is positioned within the first hinge opening when the carrier block is in the blocking configuration. The carrier block prevents translation of the bolt carrier group when the carrier blocking member is in the blocking configuration.

20 Claims, 19 Drawing Sheets

SYSTEM FOR PIVOTING A BUFFER TUBE ASSEMBLY

FIELD OF THE INVENTION

The present disclosure pertains generally to firearms. In particular, the present disclosure pertains to rifles or pistols having a reciprocating bolt.

BACKGROUND

At times, it may be desired to be able to reduce the length of a firearm to make the firearm easier to carry and/or to take up less room in storage. One way to reduce the length of a firearm is to make a stock or pistol stabilizing brace foldable, so that the stock or pistol stabilizing brace may be folded to one side of a receiver or frame of the firearm. This removes the length of the stock or pistol stabilizing brace from the overall length of the firearm, but keeps the stock or pistol stabilizing brace attached to the firearm so that the stock or pistol stabilizing brace may be easily reoriented for firing when a user wants to operate the firearm.

U.S. Pat. No. 10,704,848 to Zeider et al, titled RECEIVER WITH INTEGRAL HINGE FOR FOLDING BUFFER EXTENSION AND BUTT STOCK ASSEMBLY discloses a hinge mechanism having a fixed part integral to a lower receiver body of a firearm and a moving part to which a buffer tube is mounted. Other designs are disclosed in U.S. Pat. Nos. 8,769,855; 9,719,754; 10,113,832; U.S. Pat. Nos. 8,991,88; 10,371,474; and 11,143,470. There remains, however, a desire for new designs and improvement in this field.

SUMMARY OF THE INVENTION

The present disclosure pertains generally to firearms. In certain aspects, the present disclosure pertains to systems for firearms. In particular aspects, the present disclosure pertains to systems suitable for pivoting a buffer tube assembly relative to another portion of a firearm. In certain aspects, at present disclosure pertains to systems for pivoting a buffer tube assembly relative to a receiver of a firearm, such as an AR-15, AR-10, and/or M-16 style firearm. The system may include a first hinge portion, a second hinge portion, a lock and a bolt blocking assembly. The first hinge portion is connected to and/or integral with a first portion of the firearm, such as a lower receiver and/or an upper receiver. The second hinge portion may be connected to and/or integral with the buffer tube assembly of the firearm (e.g., the second hinge portion may be integral with a buffer tube).

The second hinge portion is at least pivotably connected to the first hinge portion and movable from a first position relative to the first hinge portion to a second position relative to the first hinge portion. In the first position, a longitudinal axis of the buffer tube assembly is parallel (e.g., co-axial) with a longitudinal axis of the bolt assembly (e.g., bolt carrier group) of the firearm. In the second position, the longitudinal axis of the buffer tube assembly may be transverse to the longitudinal axis of the bolt assembly or parallel but laterally spaced away therefrom. Movement of the second hinge portion relative to the first hinge portion is preferably rotational movement. Alternatively, movement of the second hinge portion relative to the first hinge portion may be translational movement and/or a combination of rotational and translational movement.

The lock (e.g., a latch) is configurable between a first condition and a second condition. In the first condition, the lock is capable of locking the second hinge portion in the first position relative to the first hinge portion. Preferably, the lock is configured to lock the second hinge portion in the first position simultaneously and/or after the second hinge portion configures from the second position into the first position. Movement of the second hinge portion from the second position to the first position may configure the lock from the second condition into the first condition. Preferably, the lock may be disengaged to allow the second hinge portion to move from the first position to the second position.

The bolt blocking assembly is configurable from a first configuration to a second configuration. In the first configuration, the bolt blocking assembly is configured to permit rearward movement of the bolt assembly. In the second configuration, the bolt blocking assembly is configured to resist rearward movement of a bolt assembly of the firearm (e.g., a bolt carrier group).

Preferably, the lock is in the first condition and locking the second hinge portion in the first position relative to the first hinge portion when the bolt blocking assembly is in the first configuration. Preferably, the lock enters the first condition before and/or simultaneously with the bolt blocking assembly configuring into the first configuration.

The lock is preferably biased towards the first condition. Preferably, the lock is biased by a spring towards the first condition.

The bolt blocking assembly is preferably in the second configuration when the lock is in the second condition. Preferably, even if the second hinge portion is in the first position the bolt blocking assembly is in the second configuration when the lock is in the second condition. More preferably, the bolt blocking assembly configures into the second configuration before the lock enters the second condition (e.g., before the lock leaves the first condition). Advantageously, such arrangements can ensure the bolt blocking assembly is in the second (i.e., blocking) configuration when the second hinge portion is not in the first position (e.g., when the buffer tube assembly is not in alignment with the bolt carrier group) and/or if the lock is not in the first condition.

Preferably, positioning the second hinge portion into the first position configures the bolt blocking assembly into the first configuration. Preferably, moving the second hinge portion from the first position (e.g., moving the second hinge portion into the second position) allows the bolt blocking assembly to configure from the first configuration. Preferably, moving the second hinge portion from the first position allows the bolt blocking assembly to configure into the second configuration.

The bolt blocking assembly can comprise a blocking lever and an actuation pin. The blocking lever may pivot around about a first axis between the first configuration and the second configuration. Preferably, the actuation pin actuates the blocking lever around the first axis. The actuation pin may be actuated by the second hinge portion to actuate the blocking lever. The blocking lever and/or actuation pin may be biased into the second configuration by a spring.

Further forms, objects, features, aspects, benefits, advantages, and embodiments of the present invention will become apparent from a detailed description and drawings provided herewith.

DETAILED DESCRIPTION

Figure 1:
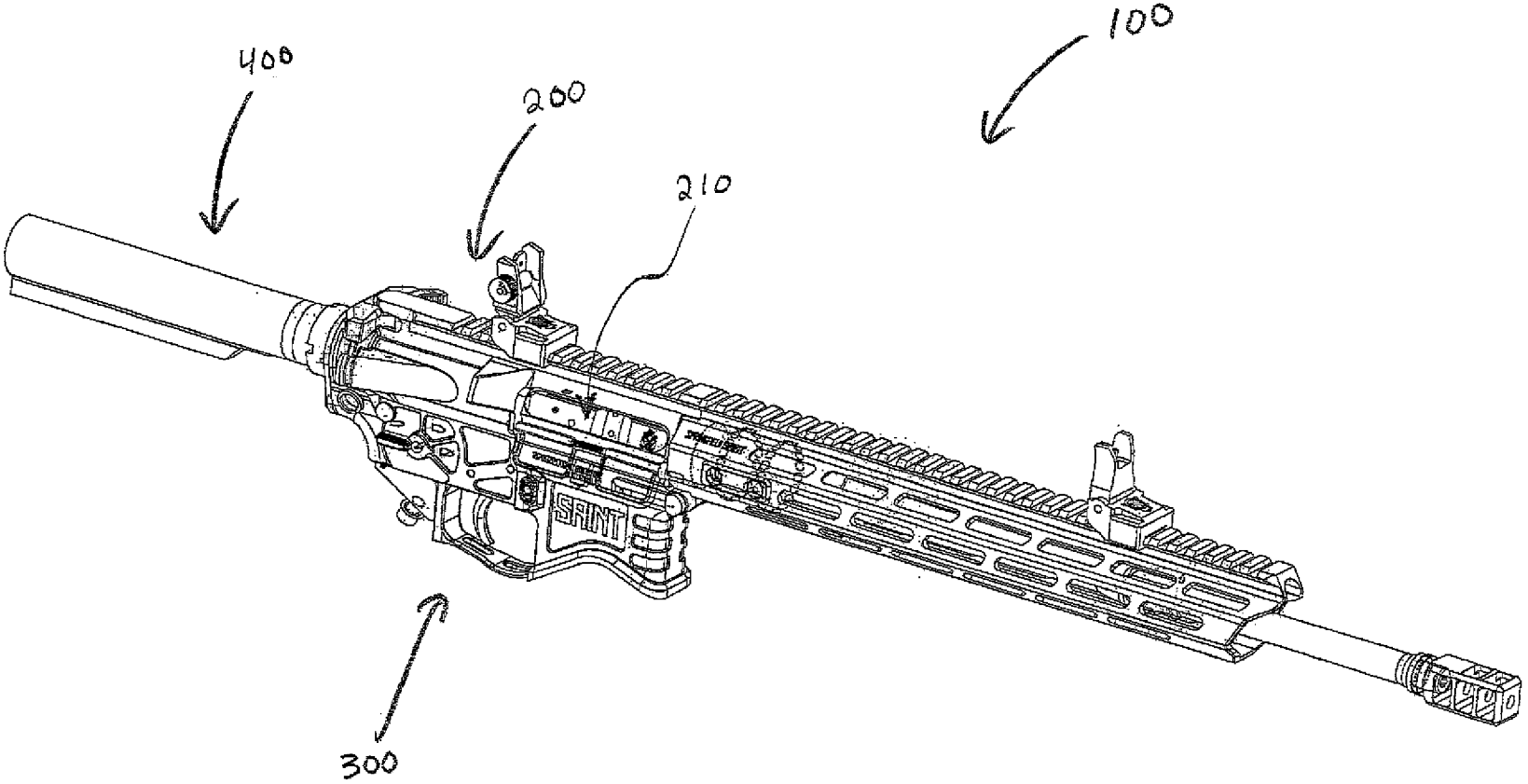
FIG. 1 is a front-right perspective view of a firearm assembly.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1 illustrates a firearm assembly 100. The firearm assembly comprises an upper receiver assembly 200 positioned atop a lower receiver assembly 300. A bolt carrier group 210 is positioned within the upper receiver assembly 200. A buffer tube assembly 400 is attached to the lower receiver assembly 300 and extends rearwardly with respect to the upper receiver assembly 200 and the lower receiver assembly 300.

Figure 2:
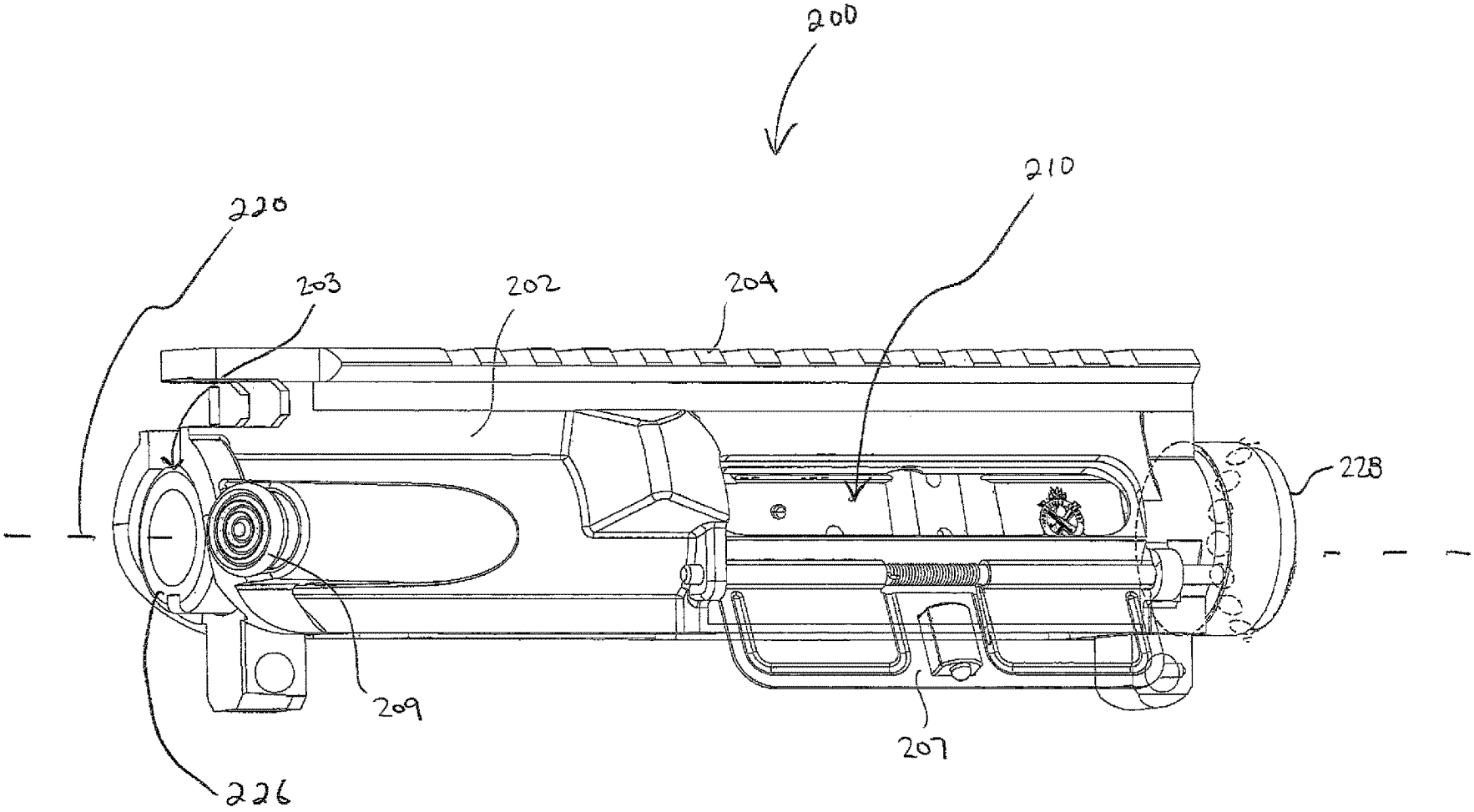
FIG. 2 is a rear-right perspective view of an upper receiver assembly of FIG. 1.

FIG. 2 illustrates a portion of the upper receiver assembly 200. The upper receiver assembly 200 includes an upper receiver body 202 that defines an upper receiver interior 203 within the upper receiver body 202. The upper receiver body 202 includes a rearward surface 226 that interfaces with the buffer tube assembly 400 when the firearm assembly 100 is assembled. The upper receiver body 202 also includes a forward surface 228 that interfaces with a barrel of the firearm assembly 100. As shown, the bolt carrier group 210 is positioned within an interior 203 of the upper receiver assembly 200 and is movable within the upper receiver interior 203. For example, during operation of the firearm, the bolt carrier group translates or reciprocates in the upper receiver along a longitudinal axis 220.

A rail 204 may be positioned on the upper receiver body 202. The rail 204 may be used for attachment of accessories to the upper receiver assembly 200. The rail 204 may be a Picatinny rail, dovetail, M-LOK, or any other suitable rail system. The upper receiver assembly also includes a dust cover 207 and a forward assist 209. The dust cover 207 may be positioned in an open orientation that allows access to the bolt carrier group 210 within the upper receiver interior 203, or the dust cover 207 may be positioned in a closed orientation that may prevent dirt and other objects from getting into the upper receiver interior 203 and interfering with operation of the bolt carrier group 210.

Figure 3:
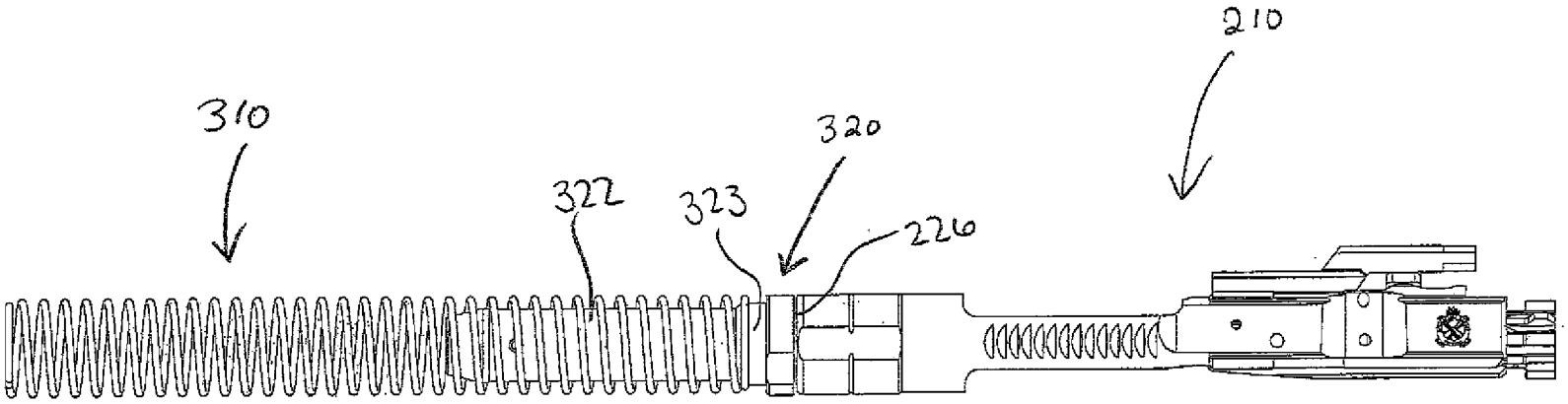
FIG. 3 is a side view of a bolt carrier group, buffer assembly, and buffer spring of FIG. 1.

FIG. 3 illustrates the bolt carrier group 210 and portions of the buffer tube assembly 400, namely a buffer spring 310 and a buffer assembly 320. The buffer assembly 320 includes a buffer 322 that has a buffer connection end 323. The buffer spring 310 at least partially surrounds the buffer 322, and may extend rearwardly with respect to the buffer 322. In some embodiments, as shown, the buffer spring 310 may not surround the buffer connection end 323. The buffer connection end 323 of the buffer assembly 320 contacts a rearward surface 226 of the bolt carrier group 210 and, in combination with the buffer spring 310, provides resistance and return force to the bolt carrier group 210 during operation the firearm.

Figure 4:
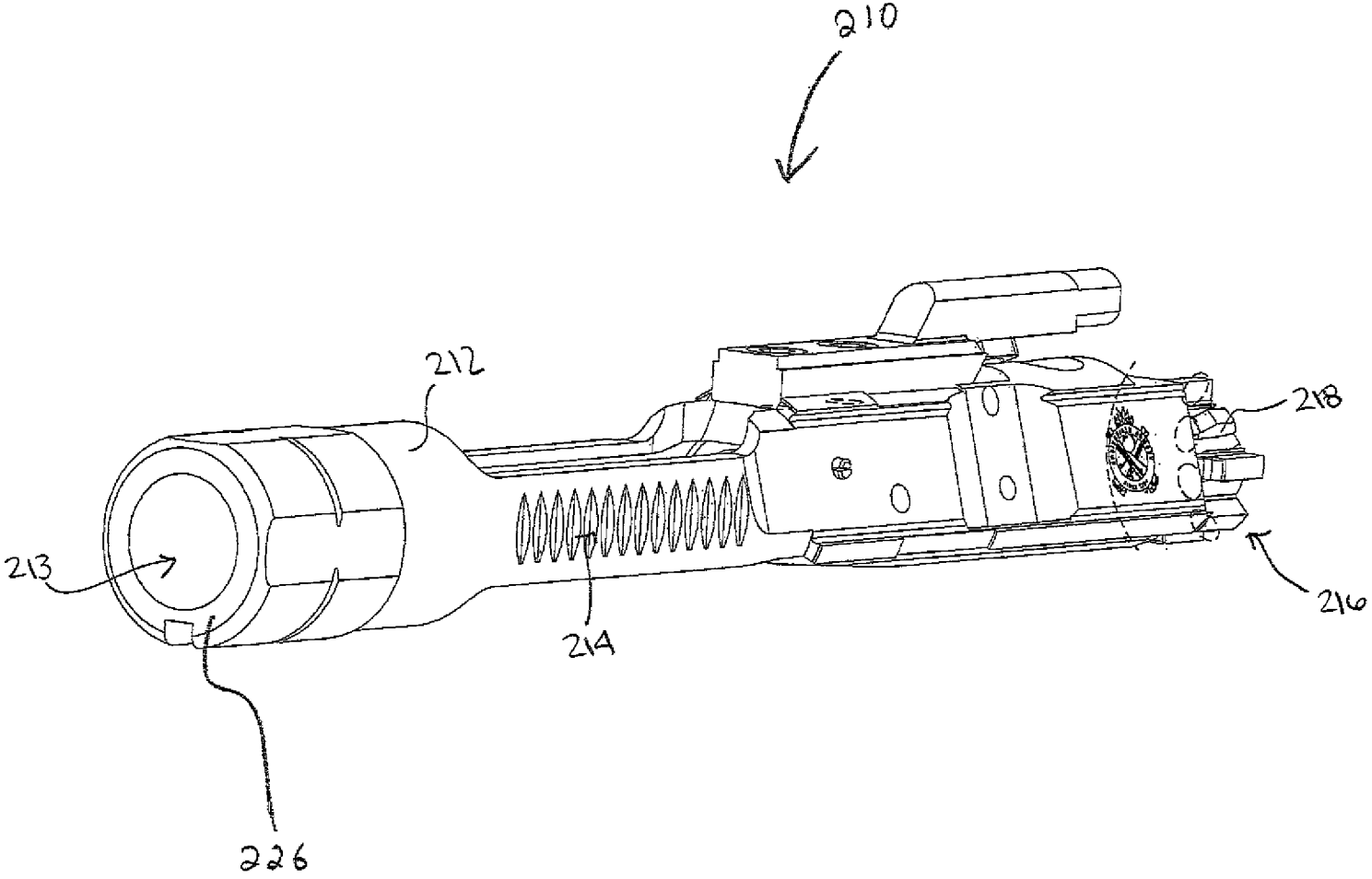
FIG. 4 is a rear-right perspective view of the bolt carrier group of FIG. 3.

FIG. 4 illustrates the bolt carrier group 210 and the rearward facing surface 226 of the bolt carrier that contacts the buffer assembly. As shown, the bolt carrier group 210 includes a bolt carrier 212. The bolt carrier 212 defines a bolt carrier opening 213 that extends through bolt carrier 212 along the longitudinal axis 220. A bolt 216 including an extractor 218 is fit at least partially within the bolt carrier opening 213. A firing pin may be fit into an opening defined through the bolt 216. A series of forward assist notches 214 are defined on one side of the bolt carrier 212. The forward assist notches 214 interact with the forward assist 209 to allow the bolt carrier group 210 to be moved in a forward direction when the forward assist 209 is operated.

FIGS. 5 through 11 illustrate a lower receiver 340 of the lower receiver assembly the firearm. The lower receiver 340 includes a lower receiver body 342 and defines a magazine well 344 for receiving a magazine. The lower receiver also includes a trigger housing 346 which holds and supports a trigger assembly of the firearm assembly 100 within the lower receiver 340. A trigger guard 348 portion of the lower receiver 340 protects and partially surrounds a trigger of the trigger assembly.

The lower receiver 340 includes a first hinge portion 350. In the embodiment shown, the first hinge portion 350 is located at the rearward end of the lower receiver 340. The first hinge portion 350 defines a first hinge opening 351. The first hinge opening 351 is aligned with the longitudinal axis 220 defined by the upper receiver assembly 200. In the illustrated embodiment, a first hinge portion 350 of the disclosed system is integral in the lower receiver. However, in other embodiments the first hinge portion 350 may be a separate component that is attachable to the lower receiver 340. In still other embodiments, the first hinge portion 350 may be coupled to or integral to the upper receiver 200.

A second hinge portion 354 is pivotally connected to the first hinge portion 350. The second hinge portion 354 defines a second hinge opening 355. The second hinge portion 354 also includes a buffer retainer pin 358, and a portion of the buffer retainer pin 358 may extend into the second hinge opening 355. As illustrated in FIGS. 5 through 11, the second hinge portion is positioned in a first, unfolded position relative to the first hinge portion 350. When the second hinge portion 354 is arranged in the unfolded position, the second hinge opening 355 is aligned with the first hinge opening 351. Therefore, when the first hinge opening 351 is aligned with the longitudinal axis 220, then the second hinge opening 355 is also aligned with the longitudinal axis 220 when the second hinge portion is in the unfolded position.

Figure 7:
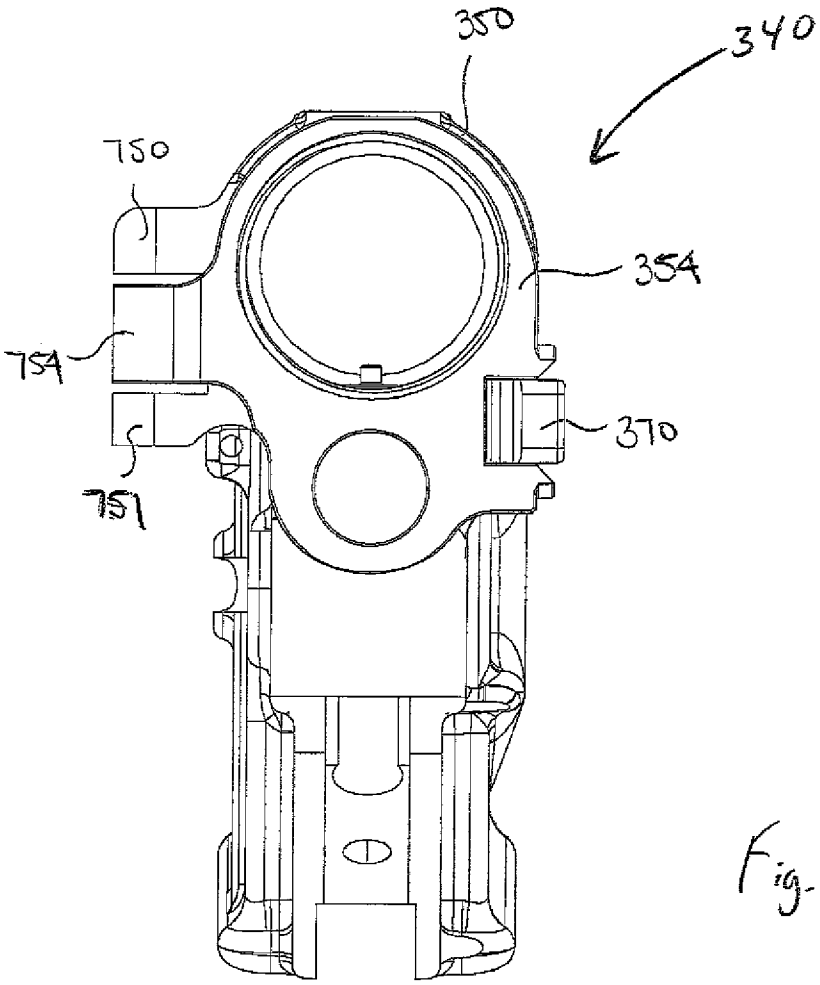
FIG. 7 is a rear view of the lower receiver and system of FIG. 5.
Figure 8:
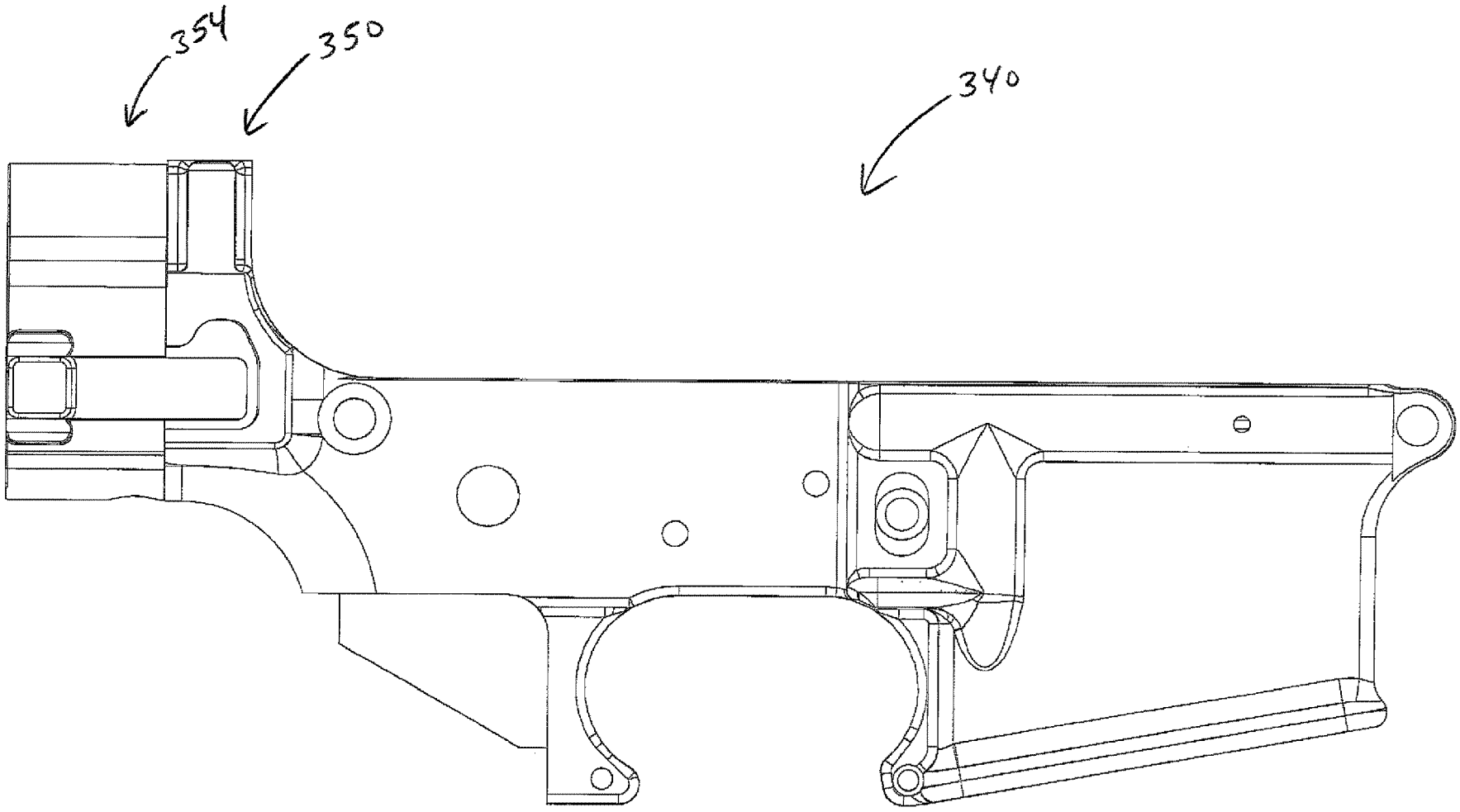
FIG. 8 is a right side view of the lower receiver and system of FIG. 7.
Figure 9:
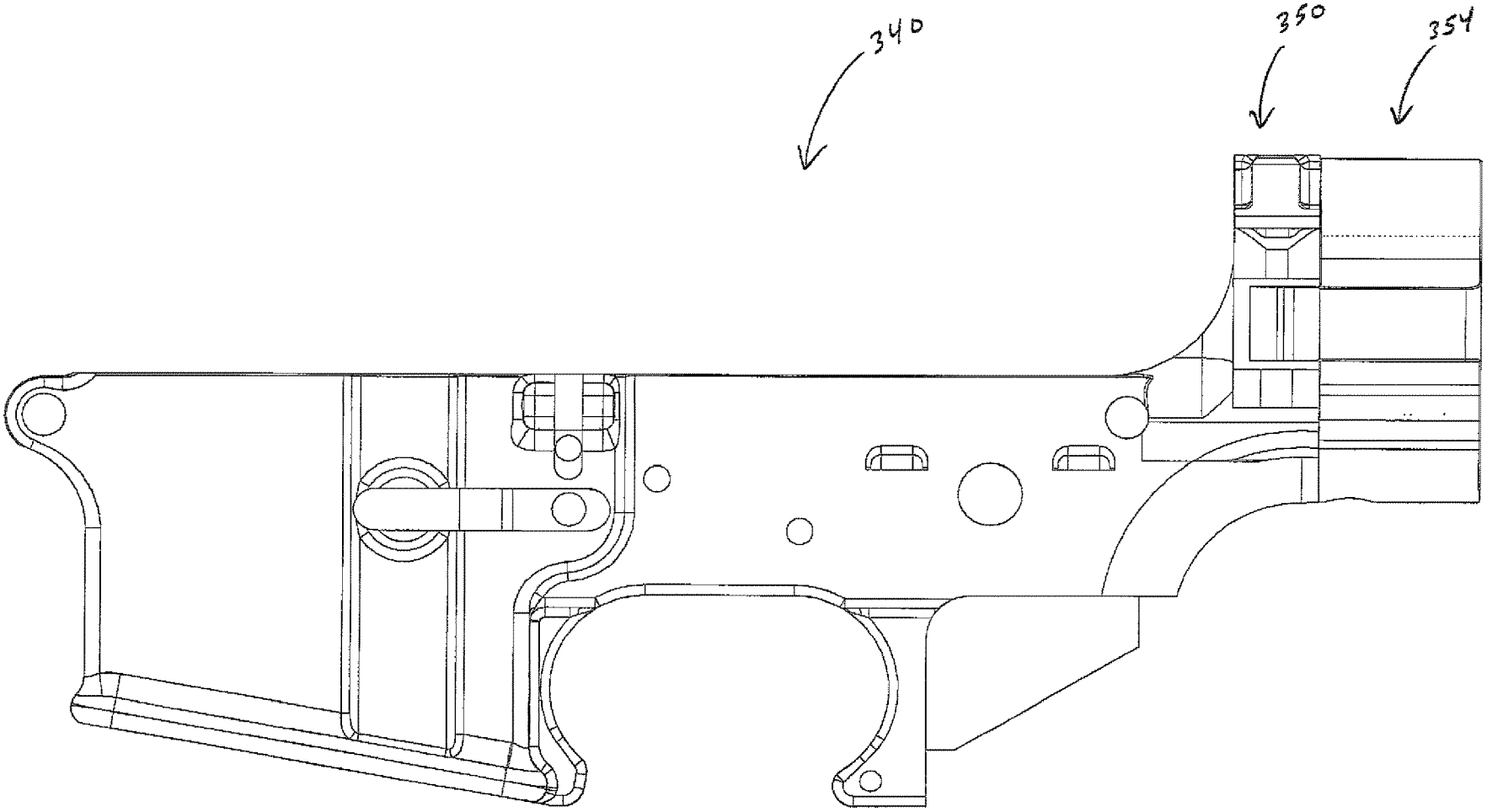
FIG. 9 is a left side view of the lower receiver and system of FIG. 7.
Figure 10:
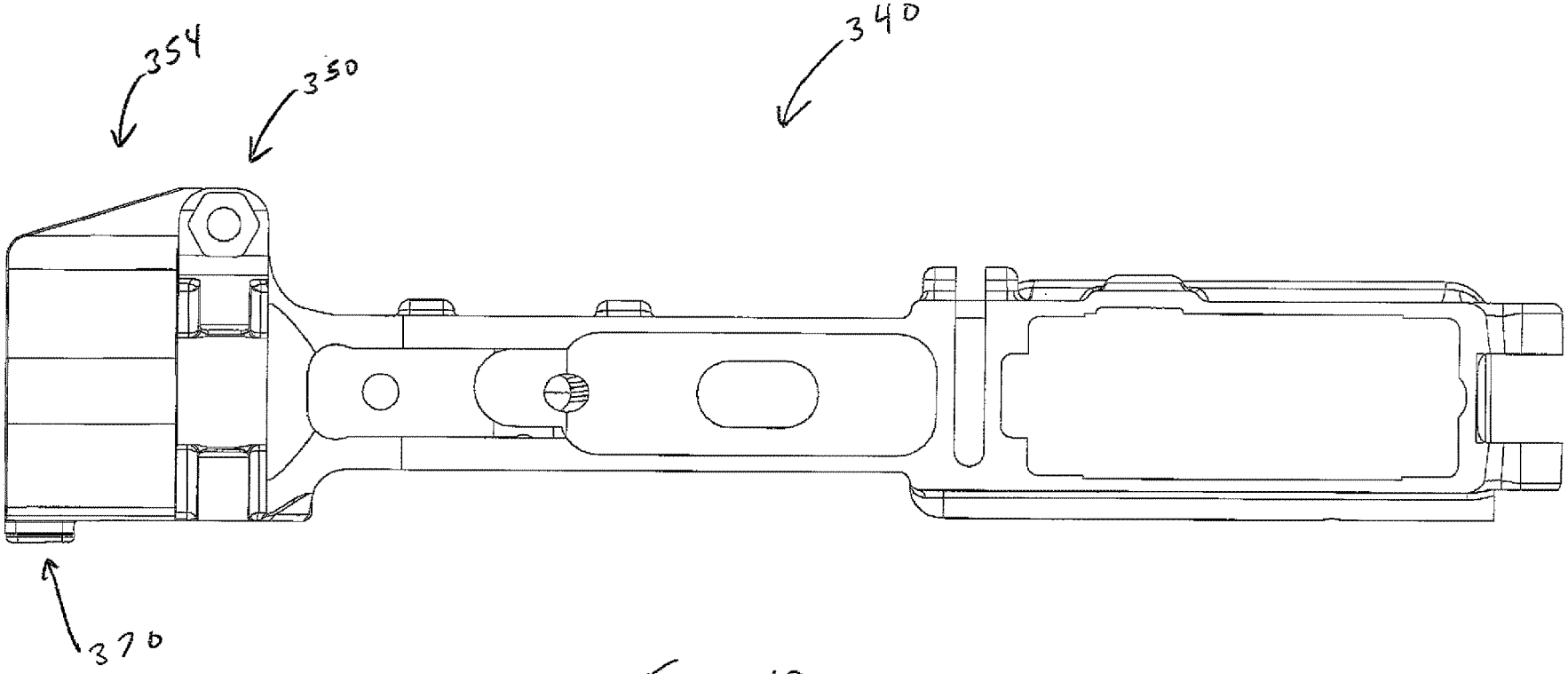
FIG. 10 is a top view of the lower receiver and system of FIG. 7.
Figure 11:
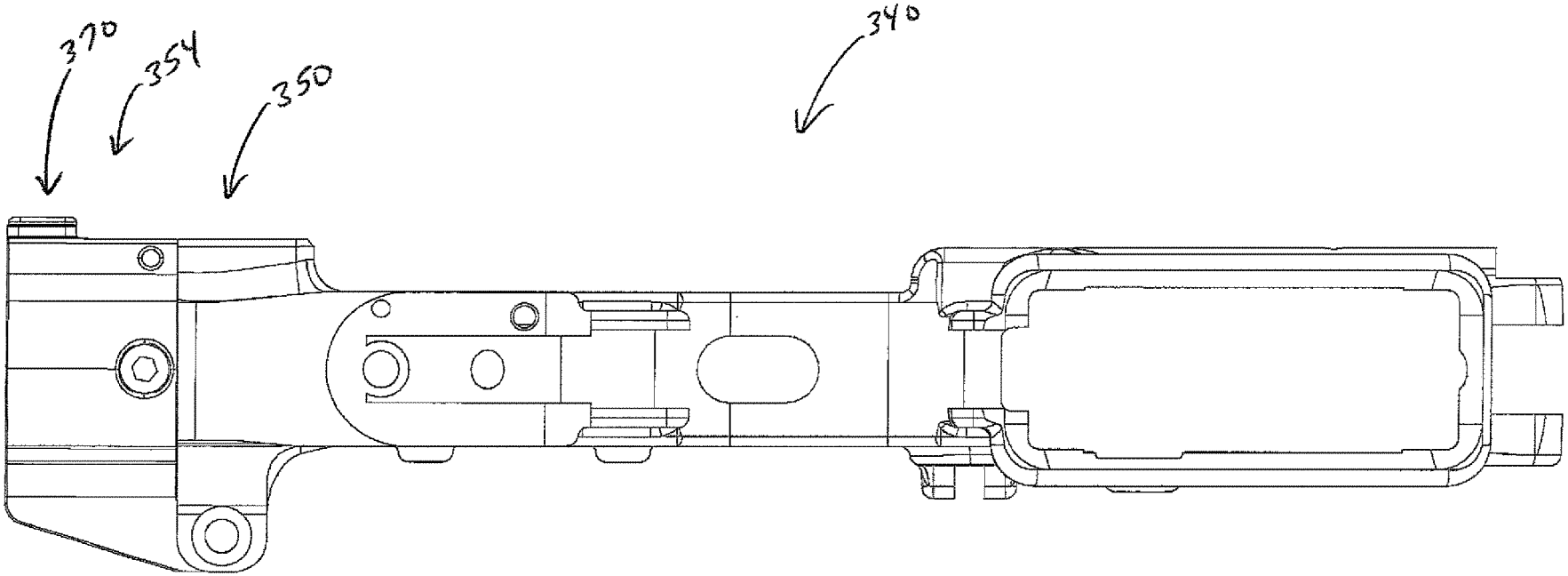
FIG. 11 is a bottom view of the system of FIG. 7.
Figure 16:
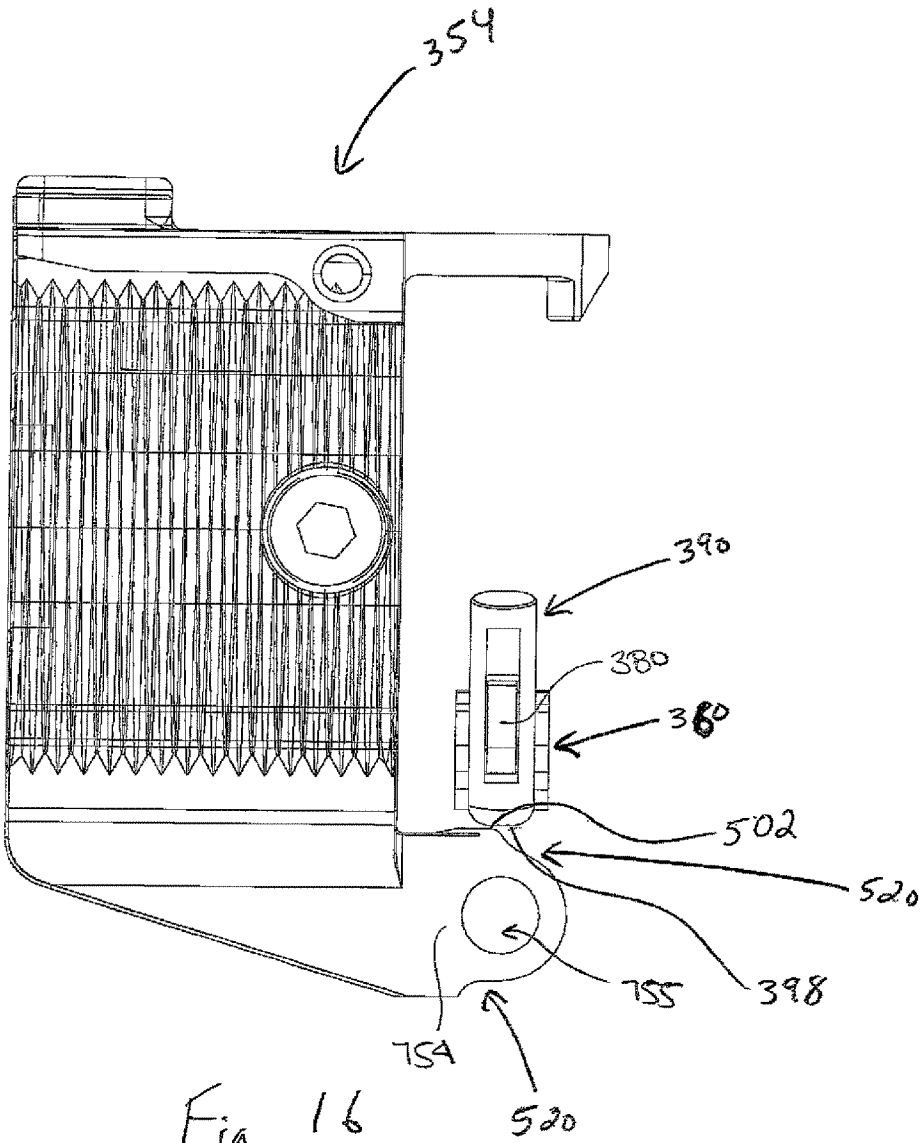
FIG. 16 is a bottom view of a portion of the system of FIG. 5 (i.e., in the first configuration).
Figure 17:
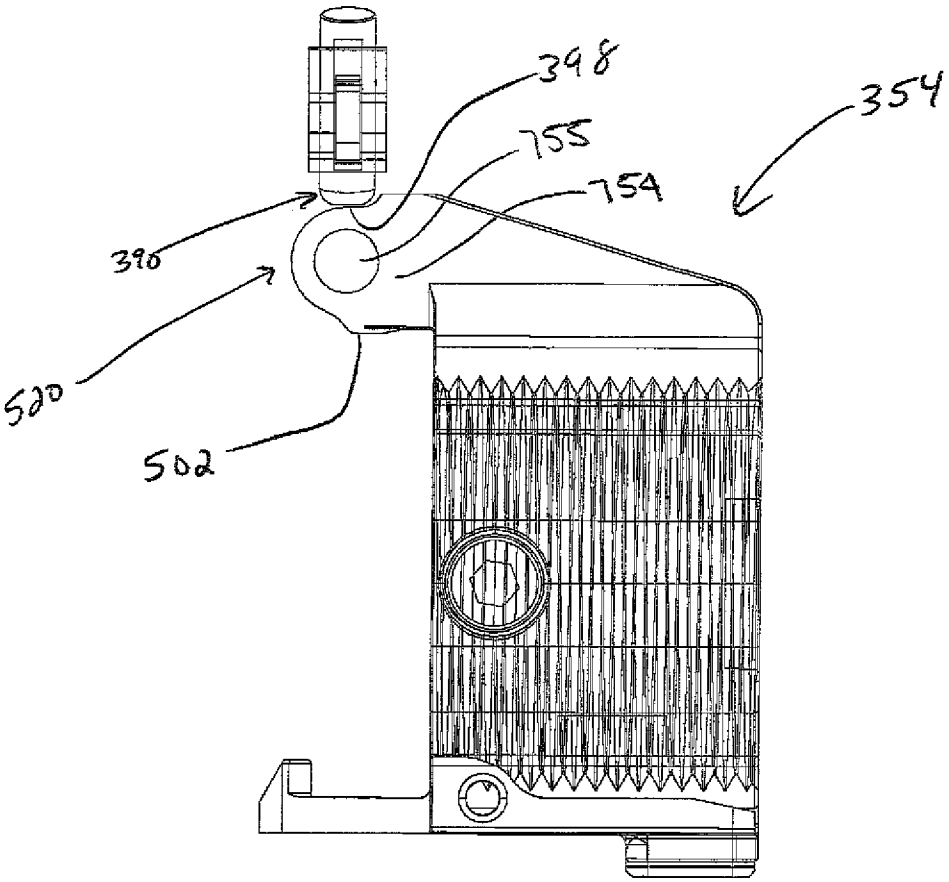
FIG. 17 is a bottom view of a portion of the system of FIG. 12 (i.e., in the second configuration)
Figure 18:
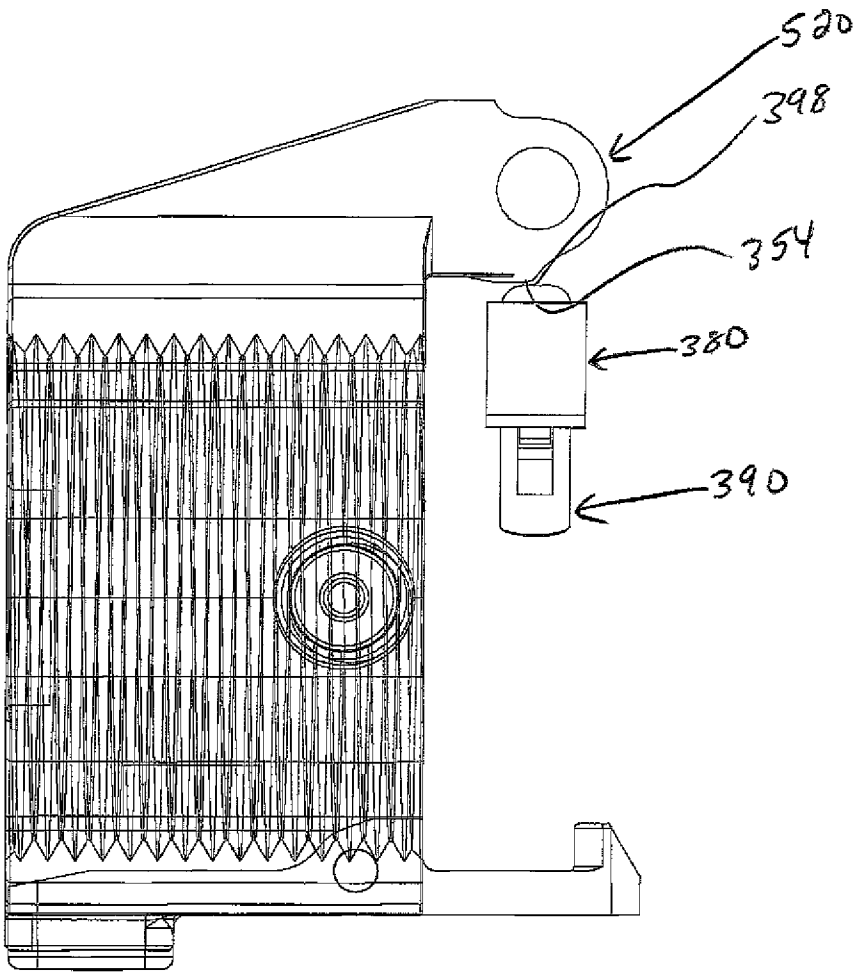
FIG. 18 is a top view of a portion of the system of FIG. 5 (i.e., in the first configuration).
Figure 19:
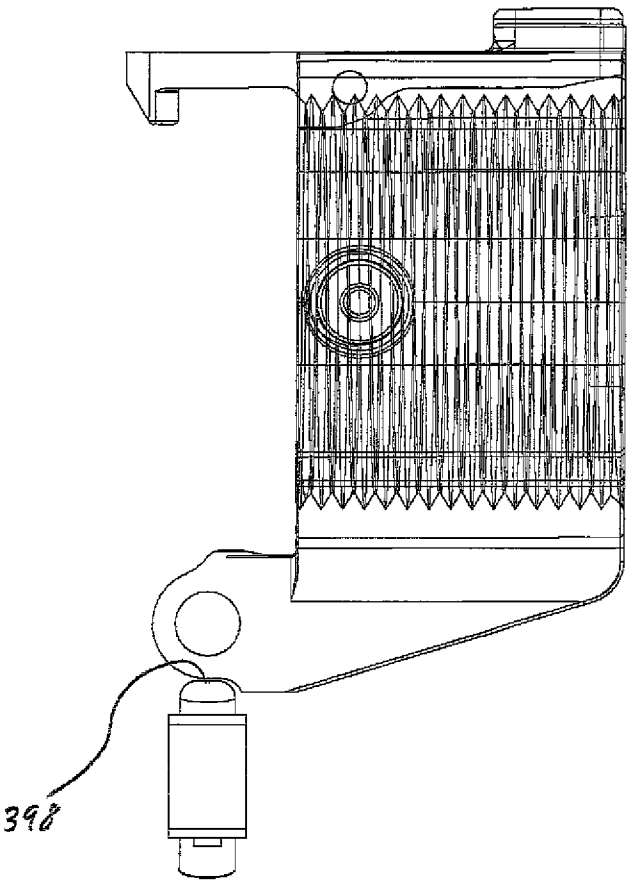
FIG. 19 is a top view of a portion of the system of FIG. 12 (i.e., in the second configuration).

As shown in FIG. 7, the first hinge portion 350 includes a pair of spaced first hinge joints 750, 751. The second hinge portion 354 includes a second hinge joint 754 that may fit in the space created by the first hinge joints 750, 751. The second hinge joint 754 defines a hinge joint opening 755 (see FIG. 16) that may receive a pin or another suitable structure for allowing the second hinge portion 354 to pivot with respect to the first hinge portion 350.

Figure 5:
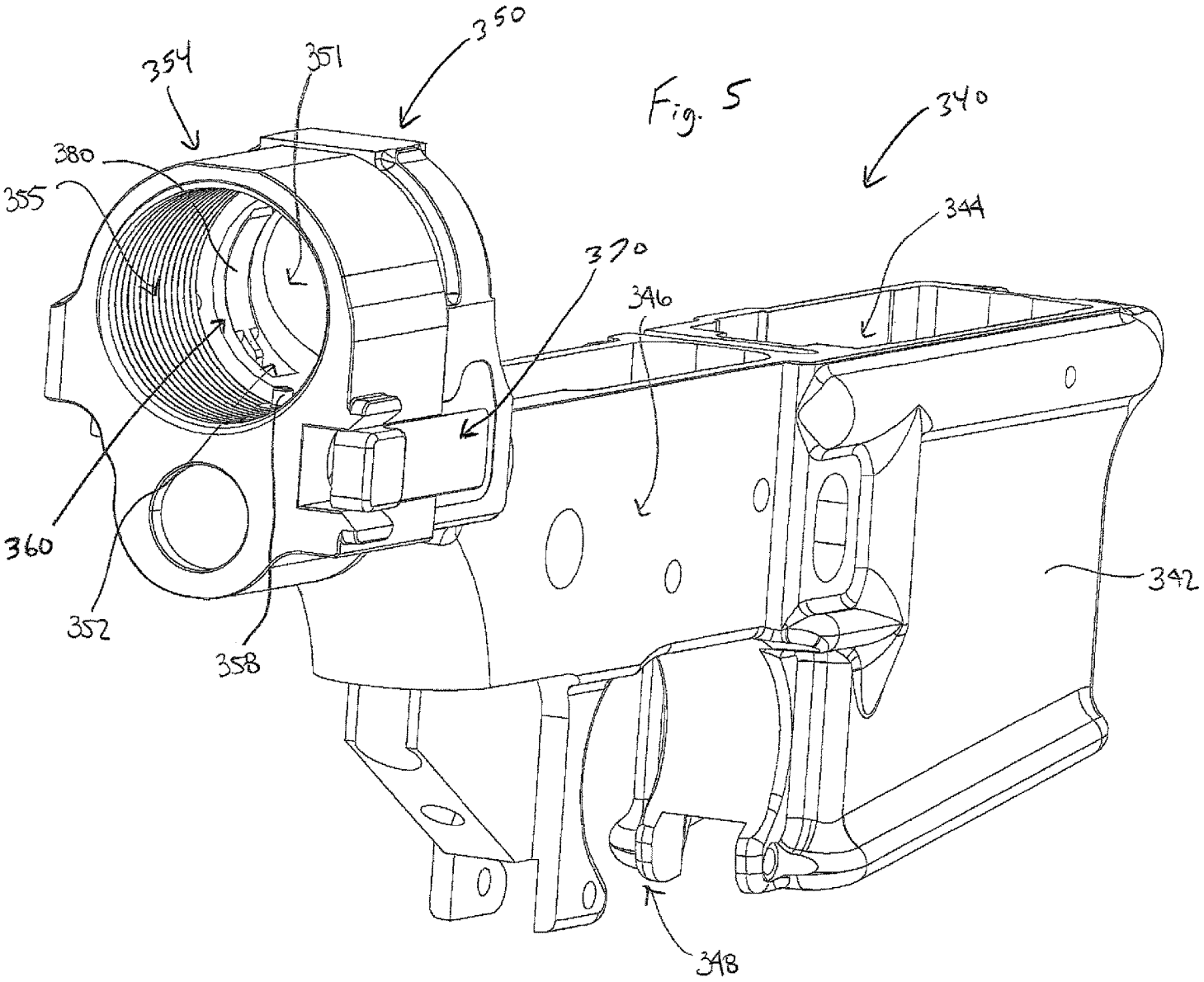
FIG. 5 is rear-right perspective view of a lower receiver and system for pivoting the buffer tube assembly in a first (e.g., unfolded) configuration.
Figure 6:
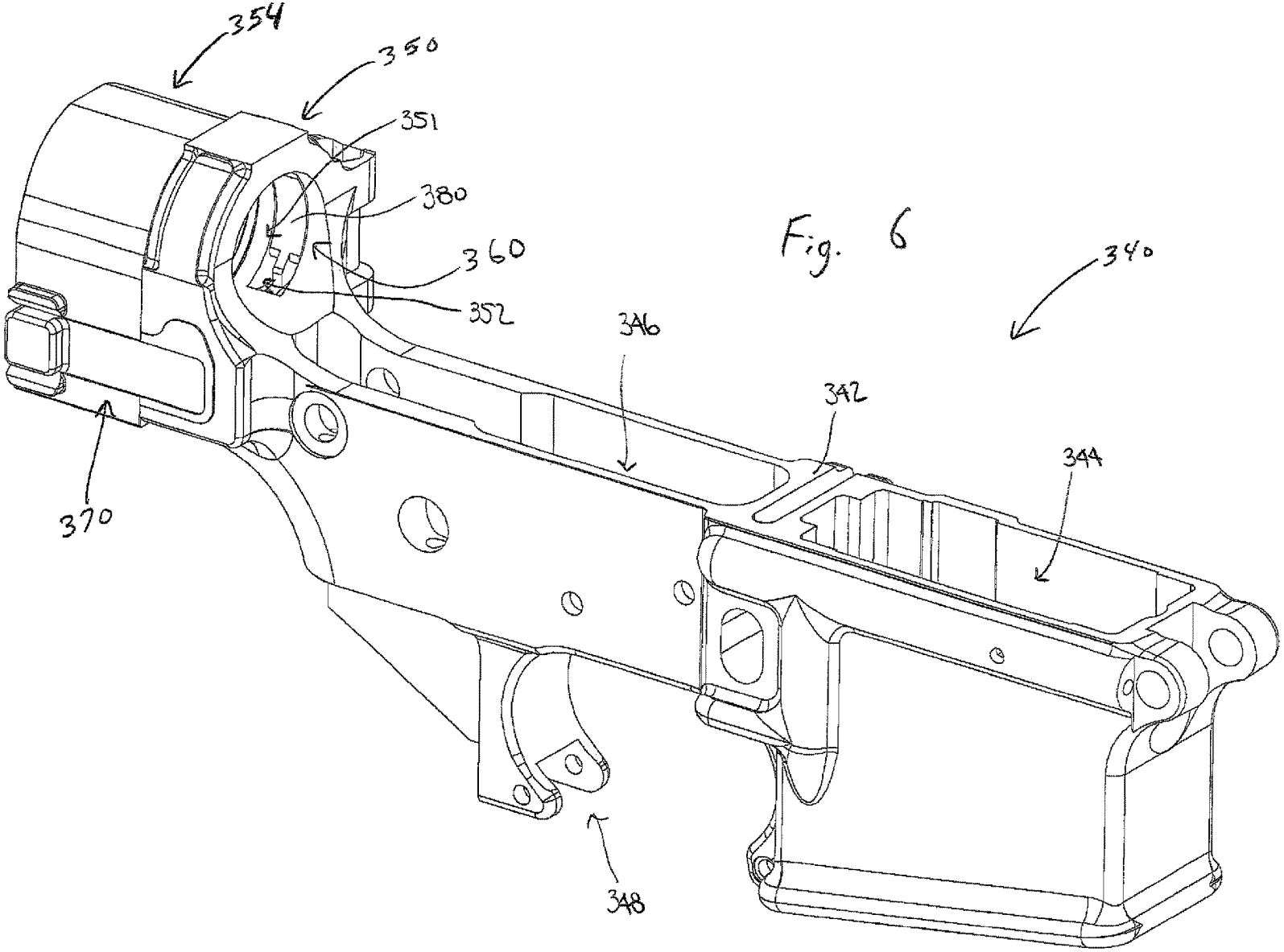
FIG. 6 is a front-right perspective view of the lower receiver and system of FIG. 5.

Also illustrated in FIGS. 5 through 7, a carrier blocking assembly 360 that includes a carrier block 380 is in a first, unblocking configuration. The carrier block 380 is positioned within a carrier blocking recess 352 defined through a surface of the first hinge portion 350. While in the unblocking configuration, the carrier block 380 is positioned within the carrier blocking recess 352 so that the carrier block 380 does not extend into the first hinge opening 351 defined through the first hinge portion 350. A lock 370 is in a first, latched condition. In the latched condition, the lock spans between the first hinge portion 350 and the second hinge portion 354 when the first hinge portion 350 and the second hinge portion 354 are arranged in the unfolded position. The lock 370 is also arrangeable in a second, unlatched condition in which the lock 370 does not secure the first hinge portion 350 to the second hinge portion 354.

Figure 12:
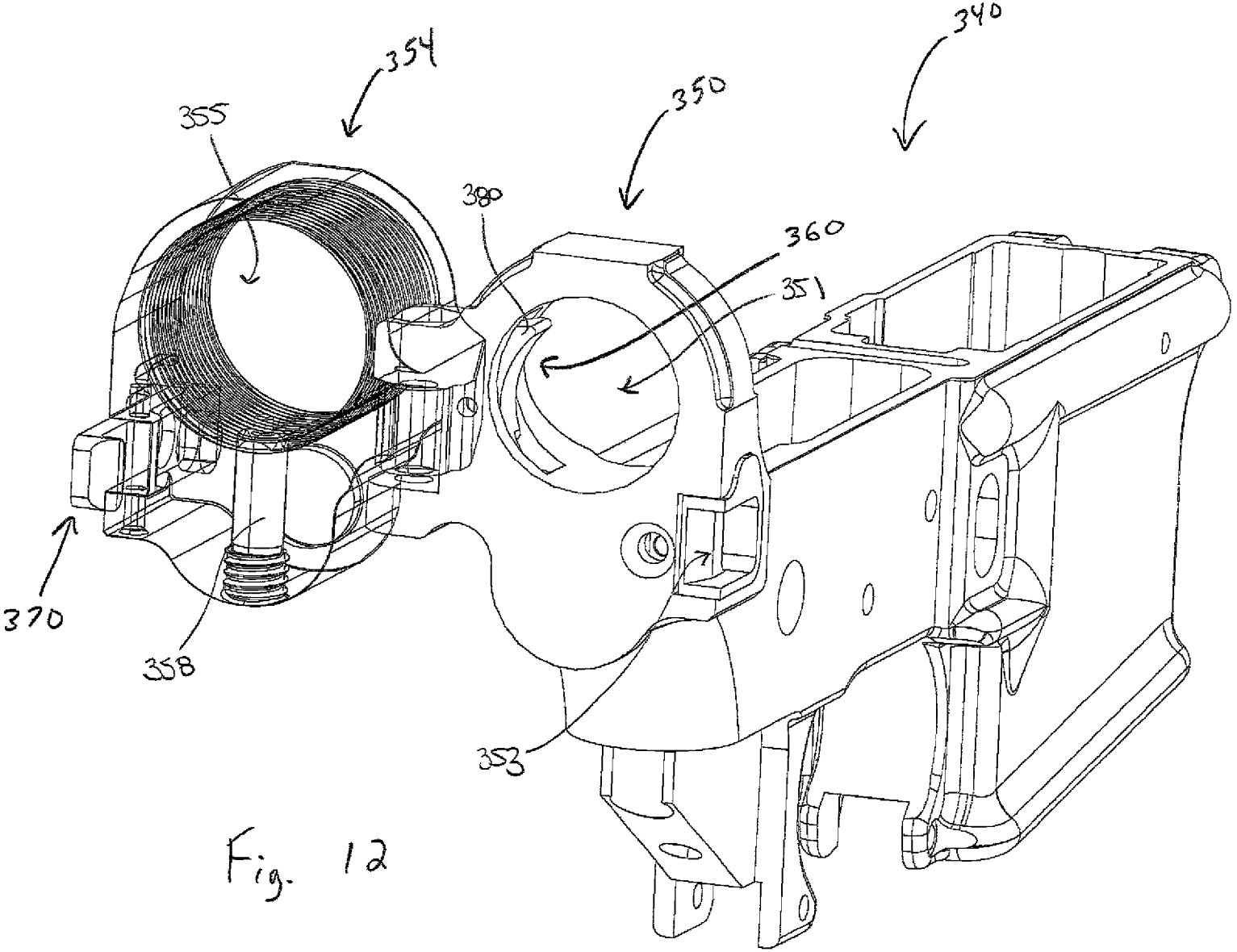
FIG. 12 is a rear-right perspective view of the lower receiver and system of FIG. 5 in a second (e.g., folded) configuration.
Figure 13:
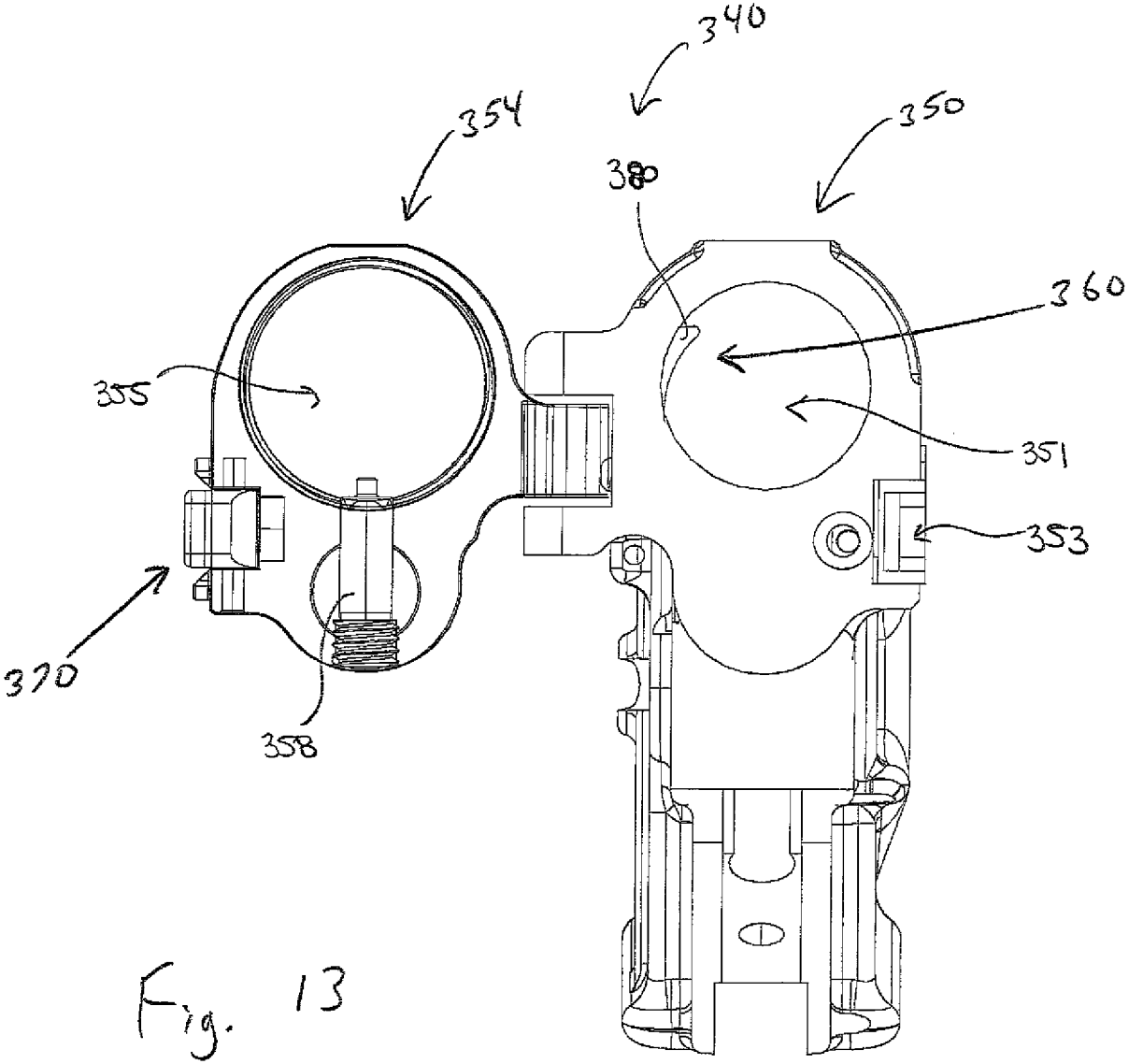
FIG. 13 is a rear view of the system of FIG. 12.

FIGS. 12 and 13 illustrate the second hinge portion in a second, folded position relative to the first hinge portion 350 and the carrier blocking assembly 360 with the carrier block 380 arranged in a second, blocking configuration. As shown, the second hinge portion 354 is pivoted with respect to the first hinge portion 350 to move the second hinge portion 354 from the unfolded position to the folded position. In the embodiment shown, the second hinge portion 354 is rotated about 180 degrees when moved from the folded position to the unfolded position. The lock 370 pivots with the second hinge portion 354, vacating a lock recess 353 defined in the first hinge portion 350.

Also, as illustrated in FIGS. 7 through 10, when the carrier block 380 is in the second, blocking configuration, at least a portion of the carrier block 380 extends into the first hinge opening 351. The positioning of a portion of the carrier block 380 in the first hinge opening 351 may act to prevent rearward movement of the bolt carrier group 210 past the first hinge portion 350 of the lower receiver 340. As the bolt carrier group 210 translates or reciprocates rearwardly, the carrier block 380 acts as a stop that prevents or resists the bolt carrier group 210 from extending through the first hinge opening 351.

Figure 14:
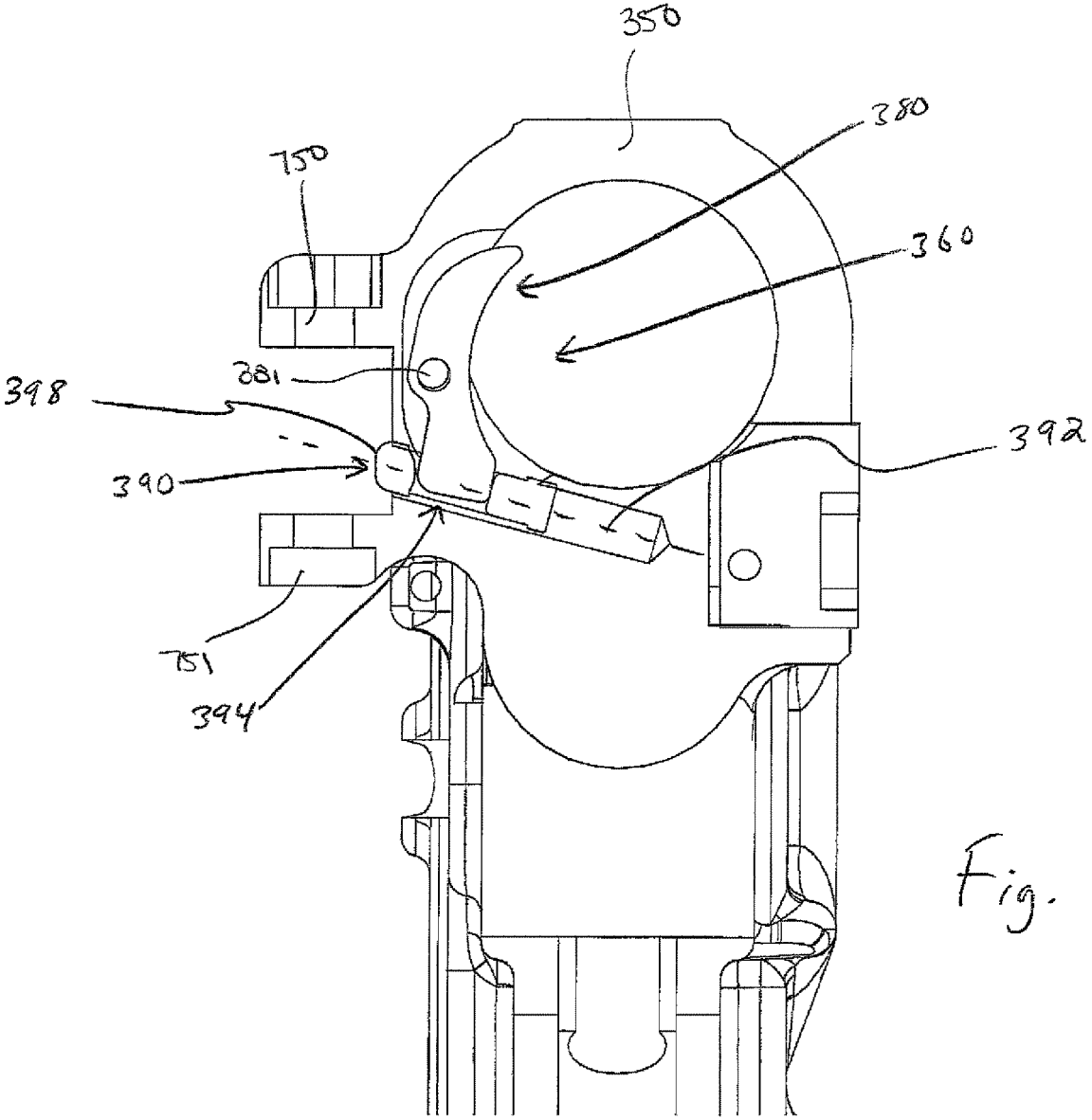
FIG. 14 is a cross-sectional view of the system of FIG. 12 (i.e., in the second configuration).
Figure 15:
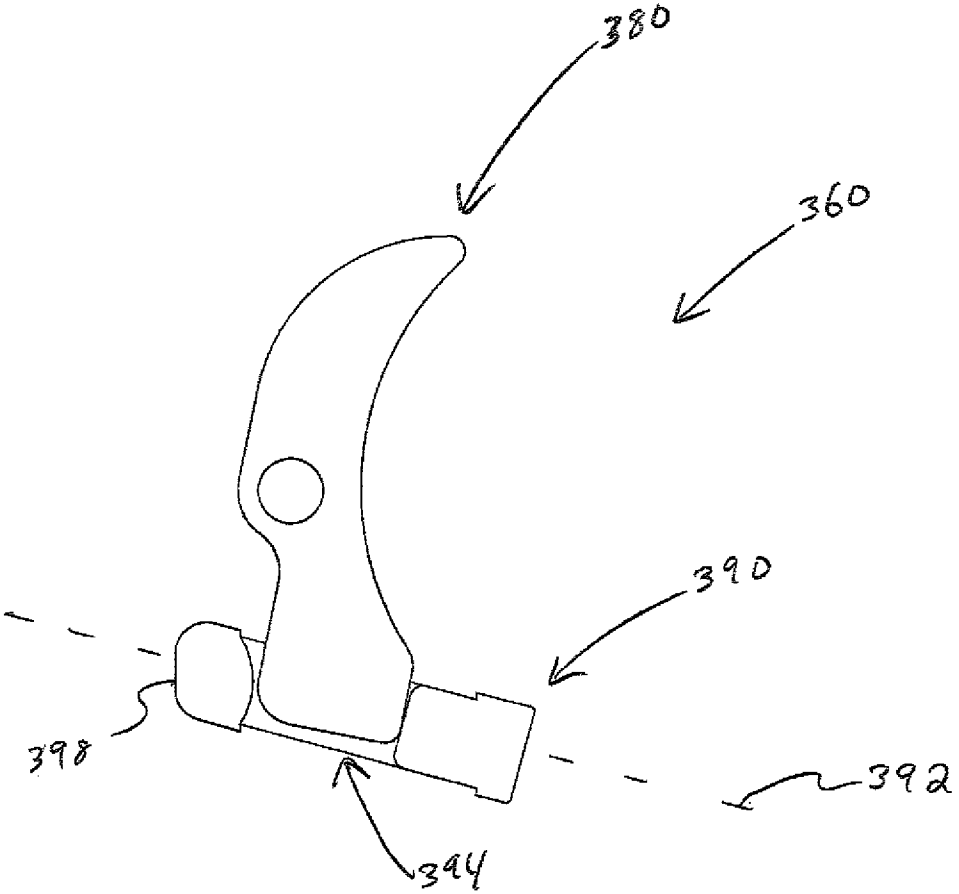
FIG. 15 is a cross-sectional view of a portion of the system of FIG. 12 (i.e., in the second configuration).

FIGS. 14 and 15 illustrate blocking assembly comprising a carrier block 380 and an actuation pin 390. The carrier block 380 may pivot about a first axis, centered at blocking lever pivot 381, between the first, unblocking configuration and the second, blocking configuration. Preferably, the carrier block 380 pivots about the first axis in response to movement (e.g., translation) of the actuation pin 390 along a longitudinal axis 392 of the actuation pin. In the illustrated embodiment, an end of the carrier block 380 is positioned within a pin recess 394 (e.g., a groove and/or slot) of the actuation pin 390.

A portion (e.g., end 398) of the actuation pin 390 is configured to contact the second hinge portion 354. As shown in FIGS. 16-19, second hinge portion 354 has a protrusion 502 configured to contact the portion of the actuation pin when the second hinge portion 354 is in the first, unfolded position (shown in FIGS. 16 and 18). In the embodiment shown, the protrusion 502 of the second hinge portion 354 is located on the second hinge joint 754. The second hinge portion 354 also includes a reduced portion 520. In the embodiment shown, the reduced portion 520 is located on the second hinge joint 754 of the second hinge portion 354. The reduced portion 520 of the second hinge portion 354 permits the actuation pin 390 to extend further out of the first hinge portion 350.

In operation, the buffer tube assembly 400 is folded with respect to the upper receiver assembly 200 and the lower receiver assembly 300 by moving the lock 370 from the latched condition to the unlatched condition. While in the latched condition, the lock 370 secures the first hinge portion 350 to the second hinge portion 354, but moving the lock 370 to the unlatched condition allows the second hinge portion 354 to hinge with respect to the first hinge portion 350. In some embodiments, the lock 370 may be unlatched by pressing the lock button 532, allowing the lever 530 of lock 570 to rotate about the lock axis 540. After the lock 370 has been moved into the unlatched condition, the second hinge portion 354 may be pivoted with respect to the first hinge portion 350. In some embodiments, the second hinge portion 354 may be rotated 180 degrees with respect to said first hinge portion 350 so that the buffer tube assembly is positioned alongside the lower receiver assembly 300.

In the unfolded position, the actuation pin 390 is in contact with the protrusion 502 of the second hinge portion 354. Then, as the second hinge portion 354 is rotated from the first, unfolded position into the second, folded position, the actuation pin 390 moves from being in contact with the protrusion 502 into the reduced portion 520 of the second hinge portion 354. As the actuation pin 390 moves into the reduced portion 520 of the second hinge portion 354, the actuation pin 390 is biased to extend further out of the first hinge portion 350. Such movement of the actuation pin 390 rotates the carrier block 380 around the first axis from the first, unblocking configuration and towards and/or into the second, blocking configuration in which at least a portion of the carrier block 380 extends into the first hinge opening 351. Therefore, when the blocking assembly is in the second, blocking configuration, a forward-facing surface of the carrier block 380 is positioned behind the rearward surface 226 of the bolt carrier group so as to block rearward travel of the bolt carrier group 210.

The buffer tube assembly 400 may be unfolded with respect to the upper receiver assembly 200 and the lower receiver assembly 300 by pivoting the second hinge portion 354 with respect to the first hinge portion 350 until the second hinge opening 355 is aligned with the first hinge opening 351. The lock 370 may then be moved from the latched condition to the unlatched condition to secure the first hinge portion 350 to the second hinge portion 354.

As the second hinge portion 354 is pivoted from the folded position to the unfolded position, the actuation pin moves from being in contact with the reduced portion 520 of the second hinge portion 354 to being in contact with the protrusion 502 of the second hinge portion 354. The additional width of the protrusion 502 compared to the reduced portion 520 deflects the actuation pin 390 along the longitudinal axis 392 further into the first hinge portion 350. As the actuation pin 390 moves into the first hinge portion 350, the actuation pin 390 applies a force on the carrier block 380, causing the carrier block 380 to rotate about the first axis at lever pivot 381 and into the first, unblocking configuration. In the unblocking configuration, the carrier block 380 does not extend into the first hinge opening 351, allowing the bolt carrier group 210 to travel rearwardly through the first hinge opening 351.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A firearm comprising:

an upper receiver defining an upper receiver interior and an upper receiver longitudinal axis;

a lower receiver;

a first hinge portion integral with or coupled to the upper receiver or lower receiver and defining a first hinge opening;

a second hinge portion including a second hinge joint, wherein said second hinge portion is pivotally connected to said first hinge portion so that second hinge portion may be configured in a folded position or an unfolded position with respect to said first hinge portion;

a bolt carrier group, wherein said bolt carrier group is translatable within said upper receiver interior;

a carrier block, wherein said carrier block is configurable in a blocking configuration and an unblocking configuration;

wherein said second hinge joint is in mechanical communication with and configured to move said carrier block when said second hinge portion is moved from said folded position to said unfolded position; and wherein at least a portion of the carrier block is positioned within said first hinge opening when said carrier block is in said blocking configuration and wherein said carrier block prevents translation of said bolt carrier group when said carrier blocking member is in said blocking configuration.

2. The firearm of claim 1, further comprising:

an actuation pin, wherein said actuation pin is positioned within a recess defined in said first hinge portion.

3. The firearm of claim 2, wherein said second hinge portion is in contact with said actuation pin when said second hinge portion is configured in said folded position.

4. The firearm of claim 2, wherein said actuation pin defines a pin recess, and wherein a portion of said carrier block is positioned within said pin recess.

5. The firearm of claim 2, wherein said second hinge portion includes a protrusion and a reduced portion;

wherein said protrusion contacts said actuation pin when said second hinge portion is configured in said unfolded position; and wherein said actuation pin contacts said reduced portion when said second hinge portion is configured in said folded position.

6. The firearm of claim 1, wherein said carrier block is in said unblocking configuration when said second hinge portion is configured in said unfolded position.

7. The firearm of claim 1, further comprising:

a lock, wherein said lock is configurable in a latched condition and an unlatched condition; and wherein said lock secures said first hinge portion to said second hinge portion when said lock is configured in the latched condition.

8. A method of folding a buffer tube assembly of a firearm, said method comprising:

pivoting a second hinge portion of the firearm with respect to a first hinge portion, so that said second hinge portion is moved from an unfolded position to a folded position with respect to said first hinge portion;

wherein a second hinge joint of said second hinge portion is in mechanical communication with and configured to move a carrier block when said second hinge portion is moved from said unfolded position to said folded position; and wherein said carrier block is moved into a blocking configuration to resist rearward movement of a bolt carrier group of the firearm when said second hinge is pivoted into the folded position.

9. The method of claim 8, further comprising:

moving a lock from a first condition in which said lock holds a second hinge portion and a first hinge portion in an unfolded position to a second condition which allows said second hinge portion to pivot with respect to said first hinge portion.

10. The method of claim 8, wherein said carrier block is positioned within a carrier blocking recess defined within said first hinge portion.

11. The method of claim 8, wherein said second hinge portion is in contact with an actuation pin and said actuation pin is in contact with said carrier block.

12. The method of claim 11, wherein an end of said actuation pin moves from being in contact with a protrusion of said second hinge joint to being in contact with a reduced portion of said second hinge joint as said second hinge portion is pivoted to the folded position with respect to said first hinge portion.

13. The method of claim 11, wherein said actuation pin translates along a longitudinal axis as the said second hinge portion is pivoted to the folded position with respect to said first hinge portion, and wherein translation of said actuation pin along said longitudinal axis causes rotation of said carrier block.

14. The method of claim 8, wherein said carrier block is rotated into said blocking configuration as said second hinge portion is pivoted to the folded position with respect to said first hinge portion.

15. A method of unfolding a buffer tube assembly of a firearm, said method comprising:

pivoting a second hinge portion with respect to a first hinge portion, so that said second hinge portion is moved from a folded position to an unfolded position with respect to said first hinge portion;

wherein a second hinge joint of said second hinge portion is in mechanical communication with and configured to move a carrier block when said second hinge portion is moved from said folded position to said unfolded position; and wherein said carrier block moves from a blocking configuration that resists rearward movement of a bolt carrier group to an unblocking configuration that allows rearward movement of the bolt carrier group when the second hinge portion is pivoted to the unfolded position.

16. The method of claim 15, further comprising:

moving a lock from a second condition to a first condition in which said lock holds said second hinge portion in said unfolded position with respect to said first hinge portion.

17. The method of claim 15, wherein said second hinge portion is in contact with an actuation pin and said actuation pin is in contact with said carrier block.

18. The method of claim 17, wherein said actuation pin is in contact with a reduced portion of said second hinge joint when said second hinge portion is positioned in the folded position, and wherein the actuation pin is in contact with a protrusion of said second hinge joint when said second hinge portion is positioned in the unfolded position.

19. The method of claim 17, wherein pivoting the second hinge portion from the folded position to the unfolded position causes said actuation pin to translate along a longitudinal axis, and wherein translation of said actuation pin along said longitudinal axis causes rotation of said carrier block from the blocking configuration to the unblocking configuration.

20. The method of claim 15, wherein said carrier block is rotated into said unblocking configuration as said second hinge portion is pivoted to the unfolded position with respect to said first hinge portion.

* * * * *